US012514283B2

(12) United States Patent
Han et al.

(10) Patent No.: US 12,514,283 B2
(45) Date of Patent: Jan. 6, 2026

(54) AEROSOL GENERATING ARTICLE, THREAD FILTER, AND COOLING ARTICLE INCLUDING THREAD FILTER

(71) Applicant: KT&G CORPORATION, Daejeon (KR)

(72) Inventors: Dae Nam Han, Seoul (KR); Jeong Hoon Kim, Seoul (KR); Jang Heun Yeum, Seoul (KR)

(73) Assignee: KT&G CORPORATION, Daejeon (KR)

( * ) Notice: Subject to any disclaimer, the term of this patent is extended or adjusted under 35 U.S.C. 154(b) by 457 days.

(21) Appl. No.: 17/917,664

(22) PCT Filed: Apr. 15, 2021

(86) PCT No.: PCT/KR2021/004767

§ 371 (c)(1),
(2) Date: Oct. 7, 2022

(87) PCT Pub. No.: WO2021/261729

PCT Pub. Date: Dec. 30, 2021

(65) Prior Publication Data

US 2023/0118486 A1 Apr. 20, 2023

(30) Foreign Application Priority Data

Jun. 23, 2020 (KR) ..... 10-2020-0076765

(51) Int. Cl.
*A24D 1/20* (2020.01)
*A24D 1/02* (2006.01)
(Continued)

(52) U.S. Cl.
CPC ..... *A24D 1/20* (2020.01); *A24D 1/02* (2013.01); *A24D 1/04* (2013.01); *A24D 3/048* (2013.01);
(Continued)

(58) Field of Classification Search
None
See application file for complete search history.

(56) References Cited

U.S. PATENT DOCUMENTS 5,423,336 A 6/1995 Mentzel et al.
10,334,875 B2 * 7/2019 Sampson ..... A24D 3/063
(Continued)

FOREIGN PATENT DOCUMENTS

CA 3 090 072 A1 8/2019
CN 103458718 A 12/2013
(Continued)

OTHER PUBLICATIONS

Korean Notice of Non-Final Rejection for 10-2020-0076765, dated May 16, 2022.
(Continued)

*Primary Examiner* — Philip Y Louie
*Assistant Examiner* — Jeffrey A. Buckman
(74) *Attorney, Agent, or Firm* — Sughrue Mion, PLLC

(57) ABSTRACT

An aerosol generating article includes: an aerosol generating unit including an aerosol generating material; a tobacco filling unit arranged at a downstream end of the aerosol generating unit; a cooling unit arranged at a downstream end of the tobacco filling unit and configured to cool an aerosol; and a thread filter arranged at a downstream end of the cooling unit and including a filter portion and a thread portion which have different flow rates of the aerosol.

11 Claims, 6 Drawing Sheets

(51) Int. Cl.

| | |
|---|---|
| ***A24D 1/04*** | (2006.01) |
| ***A24D 3/04*** | (2006.01) |
| ***A24D 3/06*** | (2006.01) |
| ***A24D 3/10*** | (2006.01) |
| ***A24D 3/12*** | (2006.01) |
| ***A24D 3/17*** | (2020.01) |

(52) U.S. Cl.
CPC ..... *A24D 3/062* (2013.01); *A24D 3/10* (2013.01); *A24D 3/17* (2020.01)

(56) References Cited

U.S. PATENT DOCUMENTS

| | | | | |
|---|---|---|---|---|
| 10,779,564 | B2 | 9/2020 | Treadaway et al. | |
| 11,839,233 | B2 | 12/2023 | Jang et al. | |
| 2012/0048286 | A1* | 3/2012 | Luan | A24D 3/043 131/344 |
| 2013/0312778 | A1 | 11/2013 | Shibuichi | |
| 2014/0196729 | A1 | 7/2014 | Ercelebi et al. | |
| 2014/0332014 | A1* | 11/2014 | Penrose | A24D 3/14 131/331 |
| 2018/0042295 | A1 | 2/2018 | Kaljura | |
| 2018/0338520 | A1 | 11/2018 | Sutton et al. | |
| 2020/0085095 | A1 | 3/2020 | Gnan | |
| 2020/0281259 | A1 | 9/2020 | Kaljura | |
| 2020/0359688 | A1 | 11/2020 | Jang et al. | |
| 2020/0397035 | A1 | 12/2020 | Lee et al. | |
| 2021/0000175 | A1 | 1/2021 | Hwang et al. | |
| 2021/0345659 | A1* | 11/2021 | Arndt | A24C 5/01 |

FOREIGN PATENT DOCUMENTS

| | | | |
|---|---|---|---|
| CN | 107427088 | A | 12/2017 |
| CN | 107567287 | A | 1/2018 |
| CN | 110312442 | A | 10/2019 |
| EP | 3 881 687 | A1 | 9/2021 |
| JP | 5-336943 | A | 12/1993 |
| JP | 2018-506289 | A | 3/2018 |
| JP | 2020-516234 | A | 6/2020 |
| KR | 10-1492493 | B1 | 2/2015 |
| KR | 10-1832517 | B1 | 2/2018 |
| KR | 10-2019-0002766 | A | 1/2019 |
| KR | 10-2019-0038301 | A | 4/2019 |
| KR | 10-2019-0093027 | A | 8/2019 |
| KR | 10-2020-0005077 | A | 1/2020 |
| KR | 10-2020-0061072 | A | 6/2020 |
| WO | 2012/105453 | A1 | 8/2012 |
| WO | 2019/151687 | A1 | 8/2019 |
| WO | 2020/009420 | A1 | 1/2020 |
| WO | 2020/100872 | A1 | 5/2020 |
| WO | 2020/105942 | A1 | 5/2020 |
| WO | 2020/116777 | A1 | 6/2020 |
| WO | 2020/183166 | A1 | 9/2020 |

OTHER PUBLICATIONS

International Search Report for PCT/KR2021/004767, dated Jul. 28, 2021.
Written Opinion for PCT/KR2021/004767, dated Jul. 28, 2021.
Extended European Search Report dated Sep. 20, 2023 in Application No. 21828190.5.
Japanese Office Action dated Dec. 12, 2023 in Japanese Application No. 2022-564364.
Chinese Office Action dated Dec. 26, 2024 in Application No. 202180025135.1.
Office Action issued Jun. 28, 2024 in Chinese Application No. 202180025135.1.
Office Action issued Jun. 25, 2024 in Japanese Application No. 2022-564364.
Communication dated Aug. 13, 2025, issued in European Application No. 21 828 190.5.

* cited by examiner

【Figure 1】
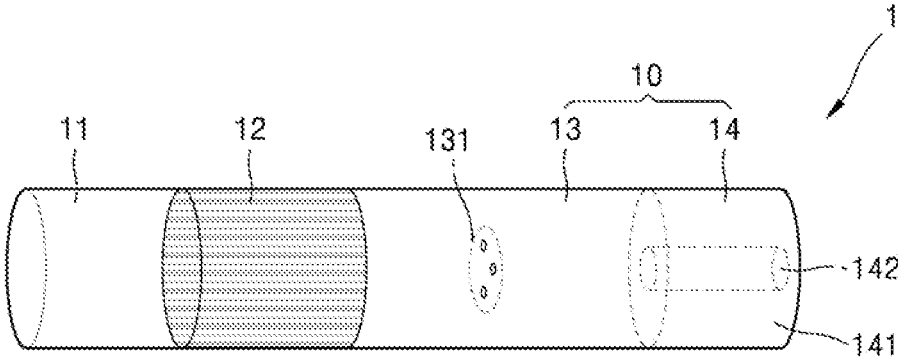
【Figure 2】
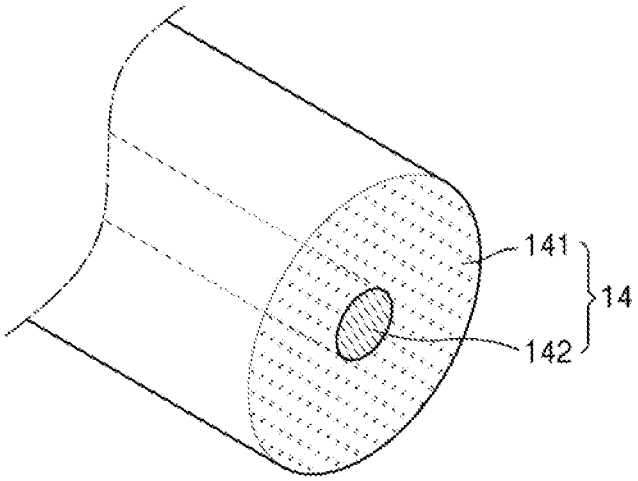
【Figure 3】
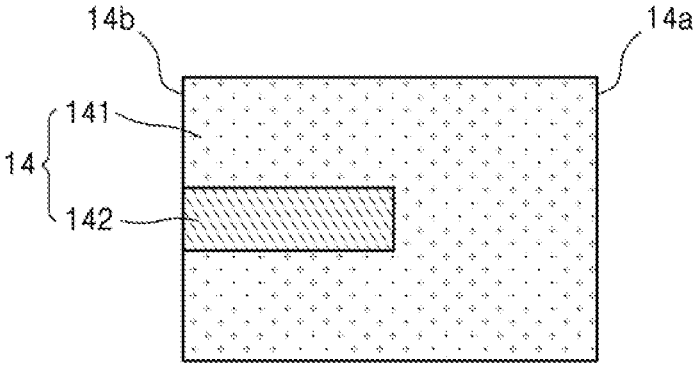

【Figure 4A】
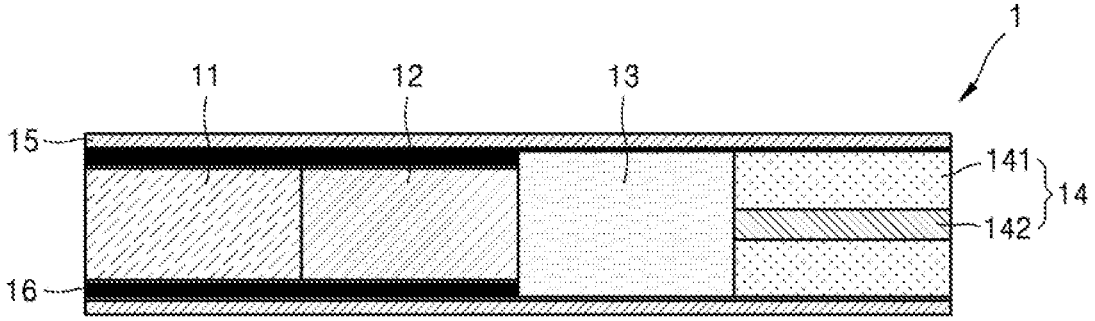
【Figure 4B】
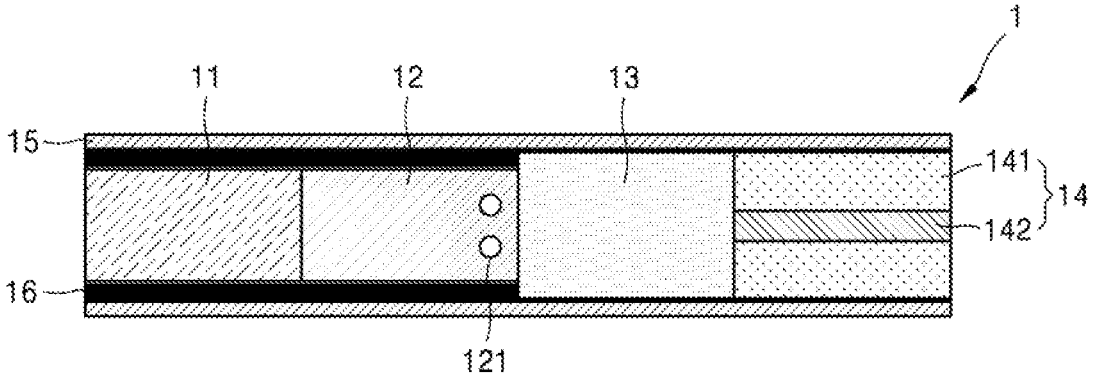
【Figure 4C】
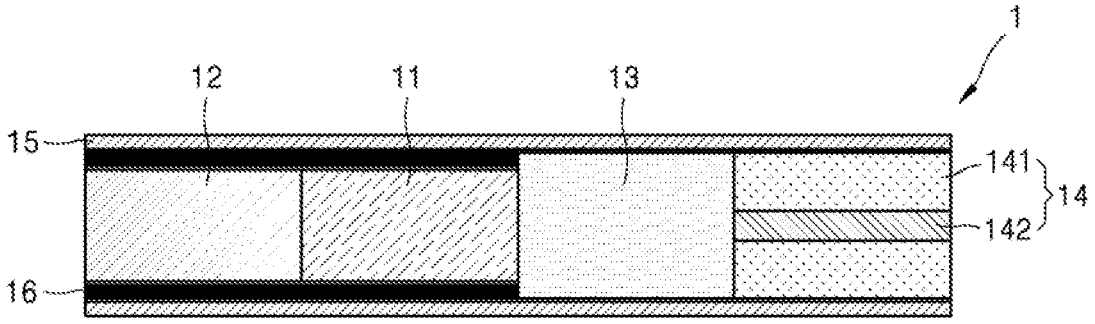
【Figure 4D】
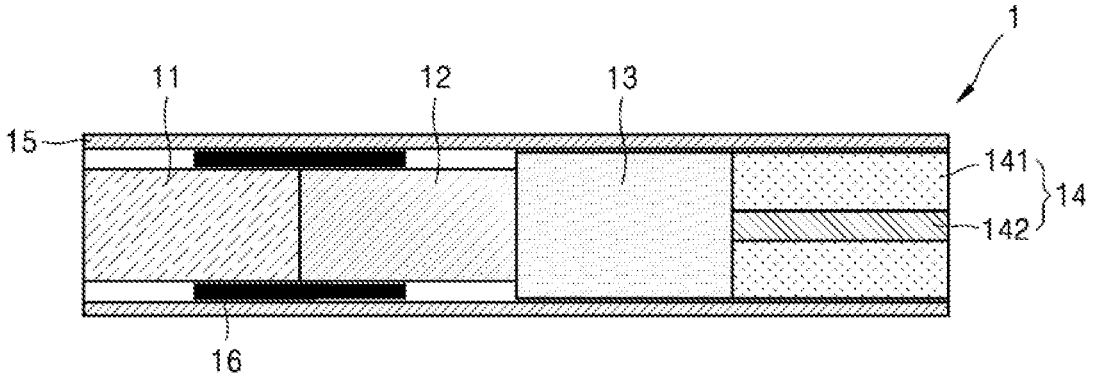

【Figure 5A】
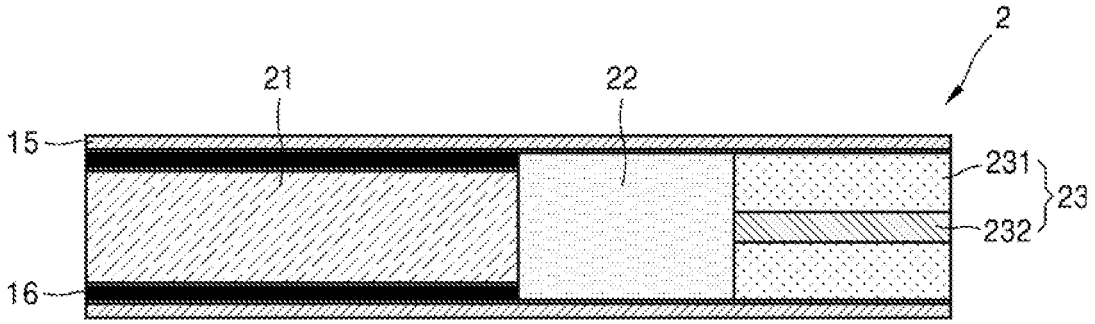
【Figure 5B】
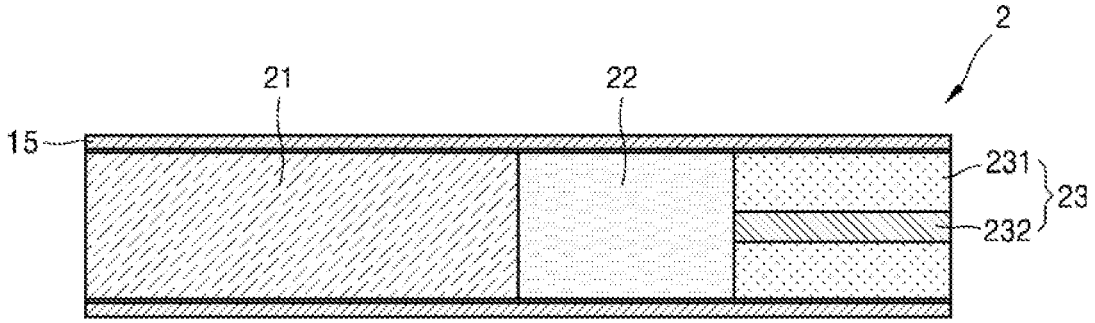
【Figure 5C】
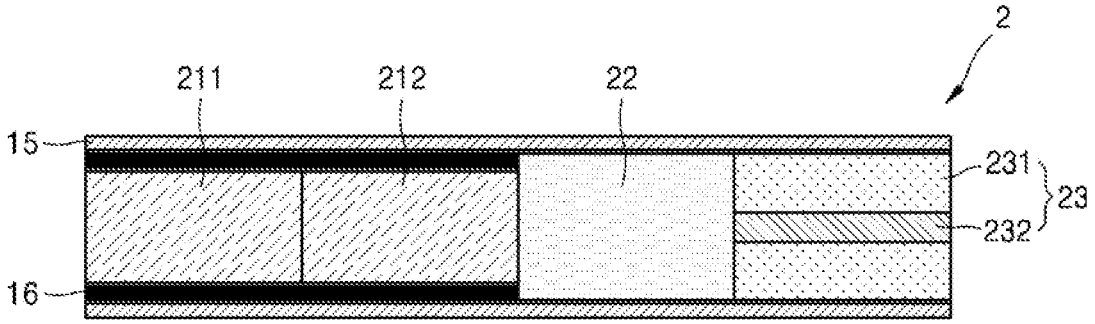
【Figure 5D】
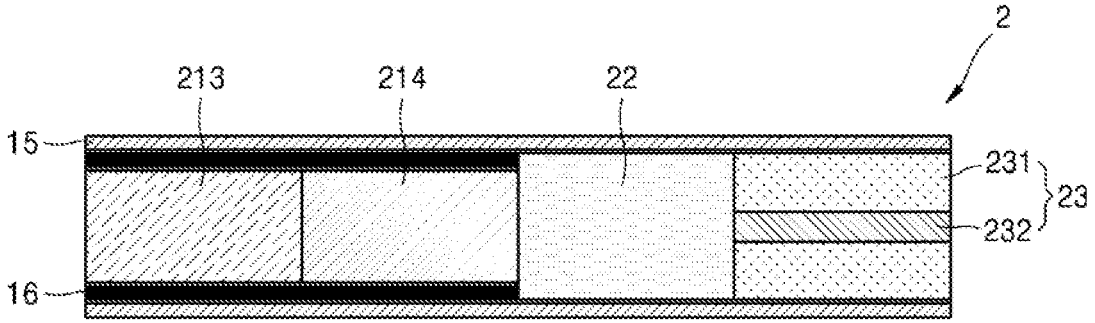

【Figure 5E】
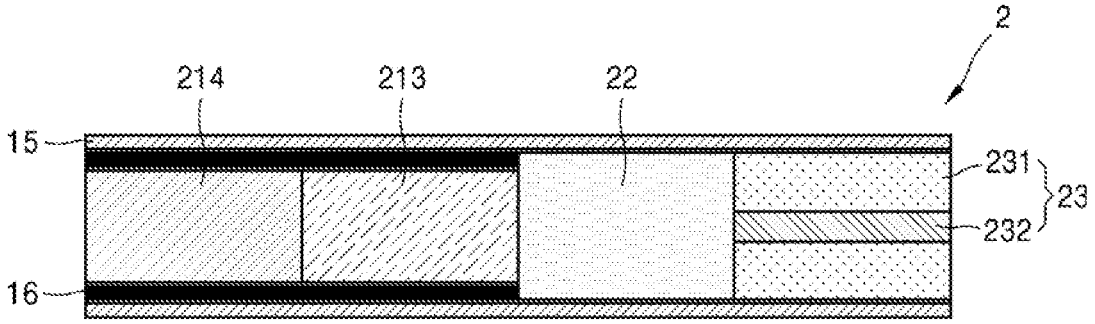
【Figure 5F】
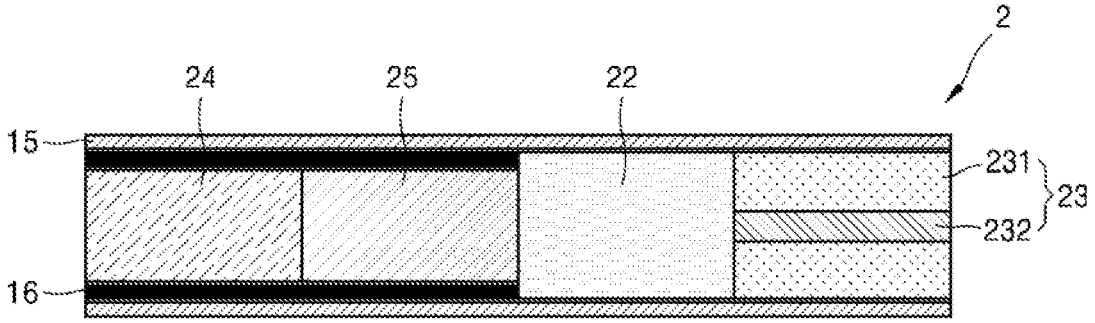
【Figure 5G】
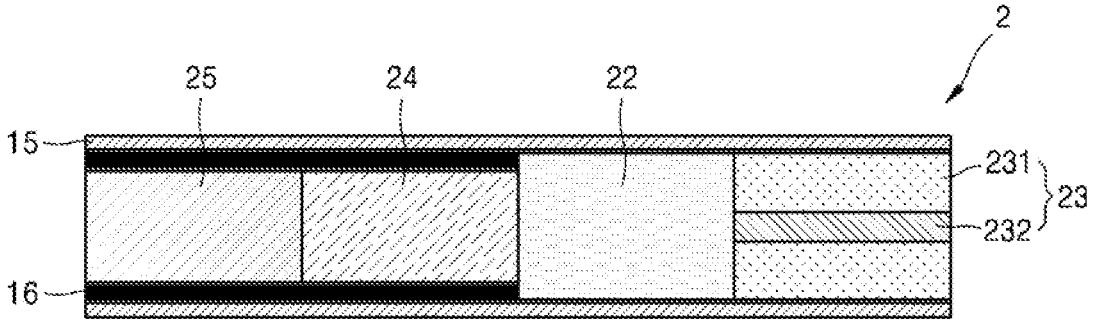
【Figure 6A】
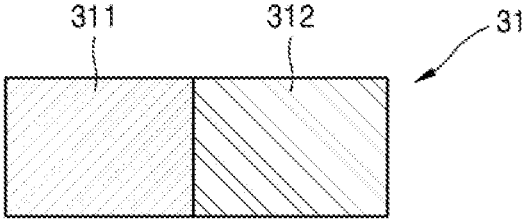

【Figure 6B】
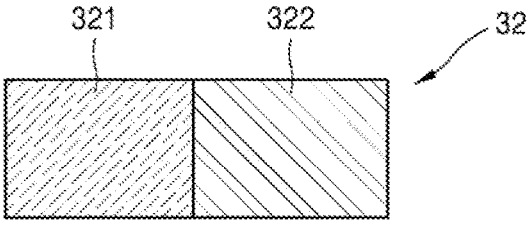
【Figure 6C】
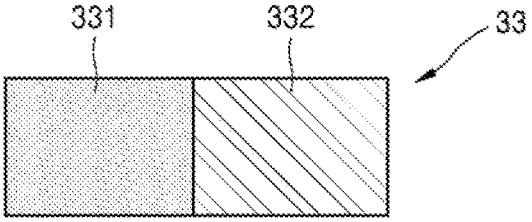
【Figure 6D】
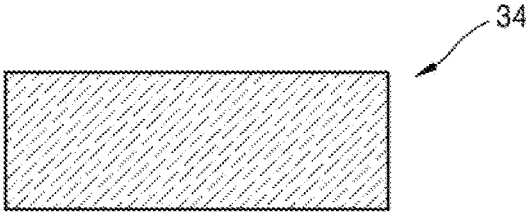
【Figure 7】
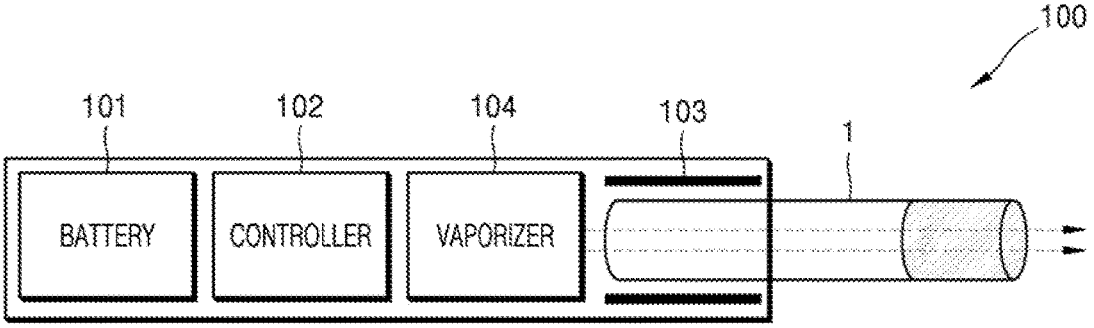

【Figure 8】
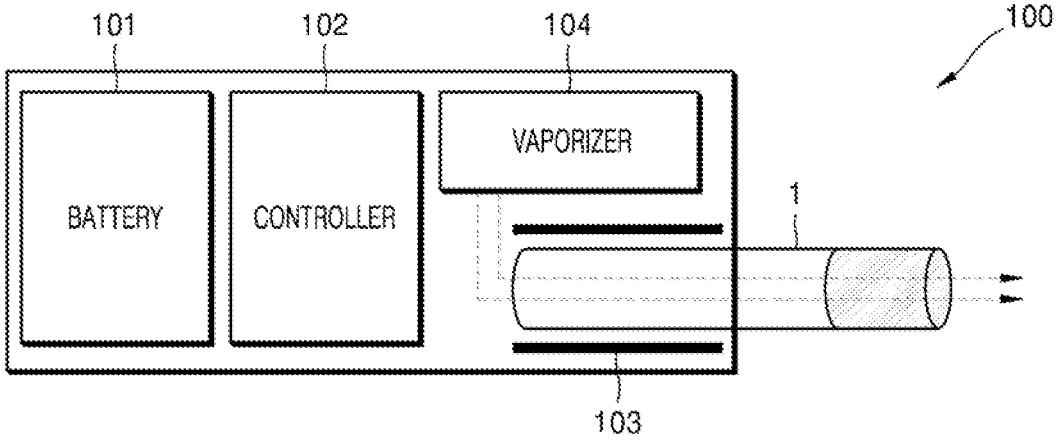

AEROSOL GENERATING ARTICLE, THREAD FILTER, AND COOLING ARTICLE INCLUDING THREAD FILTER

CROSS REFERENCE TO RELATED APPLICATIONS

This application is a National Stage of International Application No. PCT/KR2021/004767 filed Apr. 15, 2021, claiming priority based on Korean Patent Application No. 10-2020-0076765 filed Jun. 23, 2020.

TECHNICAL FIELD

One or more embodiments relate to an aerosol generating article, a thread filter, and a cooling article including a thread filter.

BACKGROUND ART

Recently, the demand for alternative methods to overcome the disadvantages of traditional cigarettes has increased. For example, there is growing demand for an aerosol generating device which generates an aerosol by heating an aerosol generating material in an aerosol generating article, rather than by combusting traditional cigarettes. Accordingly, researches on a heating-type cigarette or a heating-type aerosol generating device have been actively conducted.

DISCLOSURE

Technical Problem

One or more embodiments include an aerosol generating article, a thread filter, and a cooling article including a thread filter. The technical problems to be solved according to one or more embodiments are not limited to the technical problems as described above, and other technical problems may be inferred from the following embodiments.

Technical Solution

According to one or more embodiments, an aerosol generating article includes: an aerosol generating unit including an aerosol generating material; a tobacco filling unit arranged at a downstream end of the aerosol generating unit; a cooling unit arranged at a downstream end of the tobacco filling unit and configured to cool an aerosol; and a thread filter arranged at a downstream end of the cooling unit and including a filter portion and a thread portion which have different flow rates of the aerosol.

The thread portion may be made of a material different from that of the filter portion.

According to one or more embodiments, a thread filter for an aerosol generating article may include: a filter portion made of a first material; and a thread portion surrounded by the filter portion and made of a second material different from the first material.

Advantageous Effects

According to one or more embodiments, an overall cooling performance and flavor persistence of an aerosol generating article may be improved.

DESCRIPTION OF DRAWINGS

FIG. 1 is a schematic perspective view illustrating an example of an aerosol generating article.

FIG. 2 is a schematic perspective view of a thread filter according to one embodiment.

FIG. 3 is a schematic side cross-sectional view of a thread filter according to another embodiment.

FIGS. 4A through 4D are schematic side cross-sectional views illustrating examples of an aerosol generating article.

FIGS. 5A through 5G are schematic side cross-sectional views illustrating other examples of an aerosol generating article.

FIGS. 6A through 6D are schematic side cross-sectional views illustrating examples of a cooling unit of an aerosol generating article.

FIG. 7 is a diagram of an example in which an aerosol generating article is inserted in an aerosol generating device according to an embodiment.

FIG. 8 is a diagram of an example in which an aerosol generating article is inserted in an aerosol generating device according to another embodiment.

BEST MODE

According to one or more embodiments, an aerosol generating article includes: an aerosol generating unit including an aerosol generating material; a tobacco filling unit arranged at a downstream end of the aerosol generating unit; a cooling unit arranged at a downstream end of the tobacco filling unit and configured to cool an aerosol; and a thread filter arranged at a downstream end of the cooling unit and including a filter portion and a thread portion which have different flow rates of the aerosol.

The thread portion may be made of a material different from that of the filter portion.

The thread portion may have a greater density than the filter portion such that a larger amount of aerosol flows through the filter portion than through the thread portion.

The thread portion may have a density within a range of about 450 $kg/m^3$ to about 750 $kg/m^3$. The filter portion may have a density within a range of about 60 $kg/m^3$ to about 140 $kg/m^3$.

The thread portion may be made of a polylactic acid. The filter portion may be made of cellulose acetate.

The filter portion may have a greater volume than the thread portion.

A length of the thread portion may be less than a length of the filter portion. The thread portion may be spaced apart from a downstream end of the thread filter.

The thread portion may be arranged in a center of an area occupied by the filter portion.

At least one of the thread portion and the filter portion may include a flavoring.

The cooling unit may have at least one perforation through which external air is introduced.

A distance between the perforation and the downstream end of the cooling unit may be greater than a distance between the perforation and the upstream end of the cooling unit.

The aerosol generating article may further include a thermally conductive wrapper configured to conduct heat. The thermally conductive wrapper may be arranged on outer surfaces of the aerosol generating unit and the tobacco filling unit.

According to one or more embodiments, a thread filter for an aerosol generating article includes: a filter portion made of a first material; and a thread portion surrounded by the filter portion and made of a second material different from the first material.

The thread portion may have a greater density than the filter portion such that a larger amount of aerosol flows through the filter portion than through the thread portion.

According to one or more embodiments, a cooling article for an aerosol generating article may include: a cooling unit configured to cool an aerosol; and a thread filter arranged at an end of the cooling unit. The thread filter may include a filter portion through which the aerosol flows and a thread portion formed of a material different from that of the filter portion.

MODE FOR INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

It will be understood that, although the terms "first", "second", etc. may be used herein to describe various elements and/or components, these elements and/or components should not be limited by these terms. These terms are only used to distinguish one element or component from other elements or components.

As used herein, the term "downstream" refers to a lengthwise direction of the aerosol generating article along which the aerosol moves toward the mouth of a user in the generating article during smoking, and the term "upstream" refers to its opposite direction. The terms "downstream" and "upstream" may be used to indicate relative positions of components of the aerosol generating article.

The term "aerosol generating article" may refer to any article that is designed for smoking by a person puffing on the aerosol generating article. The aerosol generating article may include an aerosol generating material that generates aerosols when heated even without combustion. For example, one or more aerosol generating articles may be loaded in an aerosol generating device and generate aerosols when heated by the aerosol generating device. The shape, size, material, and structure of the aerosol generating article may differ according to embodiments. Examples of the aerosol generating article may include, but are not limited to, a cigarette-shaped substrate and a cartridge. Hereinafter, the term "cigarette" (i.e., when used alone without a modifier such as "general," "traditional," or "combustive") may refer to an aerosol generating article which has a shape similar to a traditional combustive cigarette.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

One or more embodiments relate to an aerosol generating article, a thread filter, a cooling article including a thread filter, and an aerosol generating device. The thread filter and the cooling article including the thread filter are included in the aerosol generating article, and thus they will be described together with the description of the aerosol generating article.

An aerosol generating article according to one embodiment includes at least one of an aerosol generating unit, a tobacco filling unit, a cooling unit, and a filter unit (e.g., a mouthpiece or a mouthpiece unit). Here, the filter unit may be a thread filter according to one or more embodiments. For example, the filter unit may be generally an acetate filter, and the cooling unit and the filter unit may include capsules and flavorings.

In an aerosol generating article according to another embodiment, an aerosol generating unit may include nicotine.

Materials, orders, and lengths of the aerosol generating unit and the tobacco filling unit are not limited to particular examples, and materials and lengths of the cooling unit and the filter unit are also not limited to particular examples.

The aerosol generating device generates an aerosol accompanied by nicotine by heating the aerosol generating unit and the tobacco filling unit, and the aerosol is discharged to the outside through the cooling unit and the filter unit.

For example, the aerosol generating device may generate an aerosol by heating at least one of the aerosol generating unit and the tobacco filling unit of the aerosol generating article. In one or more embodiments, the aerosol generating device may selectively or collectively heat the inside or outside of the aerosol generating article.

A sheet made of a thermally conductive material may be arranged on outer surfaces of the aerosol generating unit and the tobacco filling unit of the aerosol generating article, and cigarette paper fixing segments of the aerosol generating article may be arranged on an outer surface of the sheet. Here, the aerosol generating device may generate an aerosol by uniformly heating the outside of the sheet made of the thermally conductive material.

Hereinafter, one or more embodiments will now be described more fully with reference to the accompanying drawings, in which example embodiments are shown such that one of ordinary skill in the art may easily implement one or more embodiments. The disclosure may, however, be embodied in many different forms and should not be construed as being limited to the embodiments set forth herein.

Even though omitted from the description below, the above description may correspond to an aerosol generating article, a thread filter, a cooling article including a thread filter, and an aerosol generating device according to one or more embodiments.

FIG. 1 is a schematic perspective view illustrating an example of an aerosol generating article.

An aerosol generating article 1 may include a plurality of units (i.e., segments or parts). Referring to FIG. 1, the aerosol generating article 1 may include an aerosol generating unit 11, a tobacco filling unit 12, a cooling unit 13, and a thread filter 14 that includes a filter portion 141 and a thread portion 142. The cooling unit 13 and the thread filter 14 may serve to cool an aerosol, so they may be collectively referred to as a cooling article 10.

The aerosol generating article 1 according to one embodiment may be formed to have a length of about 40 mm to about 90 mm and a diameter of about 4.5 mm to about 8 mm. However, this is an example, and the aerosol generating article 1 is not limited to a particular length and diameter. Materials, orders, and lengths of the aerosol generating unit 11 and the tobacco filling unit 12 are not limited to particular examples, and materials and lengths of the cooling unit 13 and the thread filter 14 are also not limited to particular examples.

Referring to FIG. 1, the aerosol generating unit 11 may not include nicotine. In addition, the aerosol generating unit 11 may include an aerosol generating material which does not include nicotine. For example, the aerosol generating unit 11 may include at least one of glycerin, propylene glycol, ethylene glycol, dipropylene glycol, diethylene glycol, triethylene glycol, tetraethylene glycol, and oleyl alcohol. However, this is an example, and the aerosol generating unit 11 is not limited to a particular example. For example, the aerosol generating unit 11 may include a material in which glycerin and propylene glycol are mixed in a ratio of about 8:2. However, the material of the aerosol generating unit 11 is not limited to the above mixture ratio. Also, the aerosol generating unit 11 may include other additives such as flavors, a wetting agent, and/or an organic acid. In addition, the aerosol generating unit 11 may include a flavoring liquid such as menthol or a moisturizer.

The aerosol generating unit 11 may include a crimped sheet, and an aerosol generating material may be included in the crimped sheet. In addition, other additives, such as flavors, a wetting agent and/or an organic acid, and a flavoring liquid may be included in the crimped sheet.

The crimped sheet may be a sheet made of a polymer material. For example, the polymer material may include at least one of paper, cellulose acetate, lyocell, and polylactic acid. For example, the crimped sheet may be a paper sheet that does not generate off-flavor due to heat even when heated to a high temperature. However, the crimped sheet is not limited thereto.

The aerosol generating unit 11 may be formed to have a length within a range of about 4 mm to about 12 mm. However, this is an example, and the aerosol generating unit 11 is not limited to a particular length. In one or more embodiments, the aerosol generating unit 11 may be formed to have a length of about 10 mm.

As shown in FIG. 1, the tobacco filling unit 12 may be arranged at a downstream end of the aerosol generating unit 11. An aerosol generated in the aerosol generating unit 11 may flow to the cooling unit 13 through the tobacco filling unit 12. The other end (i.e., upstream end) of the aerosol generating unit 11 may be exposed to the outside.

The tobacco filling unit 12 may include nicotine. Also, the tobacco filling unit 12 may include an aerosol generating material such as glycerin or propylene glycol. In addition, the tobacco filling unit 12 may include other additives such as flavors, a wetting agent, and/or an organic acid. In addition, the tobacco filling unit 12 may include a flavoring liquid, such as menthol or a moisturizer, which is injected to the tobacco filling unit 12.

As an example, an aerosol generating material may include a pipe tobacco or reconstituted tobacco material. In detail, the aerosol generating material may include nicotine, and nicotine may be obtained by shaping or reconstituting tobacco leaves. As another example, an aerosol generating material may include free base nicotine, nicotine salt, or a combination thereof. In detail, nicotine may be natural nicotine or synthetic nicotine.

For example, the tobacco filling unit 12 may include a combination of different types of tobacco leaves. In addition, the combination may be processed through various types of treatment processes. The tobacco filling unit 12 is not limited to a particular combination.

The nicotine salt may be formed by adding, to nicotine, a suitable acid including an organic or inorganic acid. The acid for forming nicotine salt may be appropriately selected considering the rate of absorption of nicotine in the blood, a heating temperature of a heater, flavors or tastes, solubility, and the like. For example, the acid for forming nicotine salt may be a single acid or a mixture of two or more acids selected from the group consisting of benzoic acid, lactic acid, salicylic acid, lauric acid, sorbic acid, levulic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid, and malic acid. However, this is an example, and the acid is not limited to a particular example.

The tobacco filling unit 12 may be manufactured in various forms. For example, the tobacco filling unit 12 may be formed as a sheet or strands. Also, the tobacco filling unit 12 may be made of pipe tobacco, which is formed of tiny bits cut from a tobacco sheet.

The tobacco filling unit 12 may have an appropriate length within a range of about 6 mm to about 18 mm but is not limited thereto. In one or more embodiments, the tobacco filling unit 12 may be formed to have a length of about 12 mm.

The cooling unit 13 is arranged at an end (i.e., a downstream end) of the tobacco filling unit 12 and used to cool an aerosol. An aerosol flowing to the cooling unit 13 through the tobacco filling unit 12 may be cooled to a certain temperature and flow to the thread filter 14. The aerosol generating unit 11 may be arranged at the other end (i.e., an upstream end) of the tobacco filling unit 12.

The cooling unit 13 may be formed of cellulose acetate. For example, the cooling unit 13 may be manufactured by adding a plasticizer (e.g., triacetin) to a cellulose acetate tow. For example, the cooling unit 13 may have a mono denier of 5.0 and a total denier of 28,000. However, this is an example, and the cooling unit 13 is not limited to a particular mono denier.

The cooling unit 13 is made of paper and may be a tube-shaped structure having a hollow inside. The hollow included in the cooling unit 13 may have an appropriate diameter within a range of about 4 mm to about 8 mm. However, this is an example, and the hollow is not limited to a particular diameter. In one or more embodiments, the hollow of the cooling unit 13 may be formed to have a diameter within a range of about 7.0 mm to about 7.5 mm. The cooling unit 13 may be formed to have a length within a range of about 4 mm to about 30 mm. However, this is an example, and the cooling unit 13 is not limited to a particular length. In one or more embodiments, the cooling unit 13 may be formed to have a length of about 12 mm.

The cooling unit 13 may be manufactured by laminated paper made of several sheets of paper. For example, the cooling unit 13 may be manufactured by laminated paper made of outer paper, intermediate paper, and inner paper but is not limited thereto. An inner side of the inner paper constituting the laminated paper may be coated with a certain material (e.g., a polylactic acid).

When the cooling unit 13 is made of paper, a total thickness of the cooling unit 13 may be in a range of about 330 μm to about 340 μm. In one or more embodiments, the total thickness of the cooling unit 13 may be about 333 μm. However, this is an example, and the cooling unit 13 is not limited to a particular thickness.

Also, when the cooling unit 13 is made of paper, a total basis weight of the cooling unit 13 may be in a range of about 230 $g/m^2$ to 250 $g/m^2$. In one or more embodiments, the total basis weight of the cooling unit 13 may be about 240 $g/m^2$ but is not limited thereto.

The cooling unit 13 may have at least one perforation 131 through which external air is introduced. Therefore, the aerosol generating article 1 according to one or more embodiments may cool an aerosol by using external air, and thus improve an overall cooling performance. Also, external air may be introduced through the perforation 131 when a user puffs on the aerosol generating article 1, which increases an amount of atomization.

The perforation 131 may be formed in each of the cooling unit 13 and a wrapping material (a wrapper 15 shown in FIGS. 4A through 4D). In this case, the perforation 131 formed in the cooling unit 13 and the perforation 131 formed in the wrapping material 15 may be at corresponding locations.

Although not shown, the perforation 131 may be formed through the cooling unit 12 along a radial direction. The radial direction may be a direction perpendicular to a longitudinal direction (i.e., lengthwise direction) of the aerosol generating article 1. The perforation 131 may be implemented as a hole of a cylindrical shape, but this is an example. As long as external air is introduced through the perforation 131, the shape of the perforation 131 is not limited.

A distance between the perforation 131 and an upstream end of the cooling unit 13 may be greater than a distance between the perforation 131 and a downstream end of the cooling unit 13. Therefore, a cooling effect through the perforation 131 may start from a point relatively far from the thread filter 14. Accordingly, in the aerosol generating article 1, a time for which external air stays inside the cooling unit 13 may increase, and thus, a cooling performance by the external air may be further improved.

The cooling unit 13 and the perforation 131 are not limited to the examples described above and may include all types of cooling units and perforations capable of cooling an aerosol.

FIG. 2 is a schematic perspective view of a thread filter 14 according to one embodiment.

Referring to FIGS. 1 and 2, the thread filter 14 is arranged at a downstream end of the cooling unit 13. An aerosol that is cooled through the cooling unit 13 may be inhaled by a user through the thread filter 14.

The thread filter 14 may include a filter portion 141 and a thread portion 142 which provide different flow rates of the aerosol.

The filter portion 141 may provide a primary flow passage for an aerosol. In other words, the filter portion 141 may have a higher flow rate of the aerosol than the thread portion 142. The filter portion 141 may be manufactured by adding a plasticizer (e.g., triacetin) to a cellulose acetate tow. The filter member 141 may be formed to have a length within a range of about 4 mm to about 30 mm. However, this is an example, and the filter portion 141 is not limited to a particular length. In one or more embodiments, the filter portion 141 may be formed to have a length of about 14 mm.

The filter portion 141 may be manufactured to generate flavors. As an example, a flavoring liquid may be injected into the filter portion 141, or an additional fiber coated with a flavoring liquid may be inserted into the filter portion 141.

Also, the filter portion 141 may include at least one capsule. As an example, a capsule may include a flavoring liquid, and flavors may be generated by the flavoring liquid that leaks due to crushing of the capsule. As another example, a capsule may include an aerosol generating material, and an aerosol may be generated by the aerosol generating material that leaks due to crushing of the capsule. The capsule may have a configuration in which a flavoring liquid or an aerosol generating material is wrapped with a film. The capsule may have a spherical or cylindrical shape but is not limited thereto.

The thread portion 142 is arranged in an area not occupied by the filter portion 141. The thread portion 142 may have a particular shape to be coupled to the filter portion 141 or mixed with the filter portion 141. The thread portion 142 may be formed to have a length within a range of about 4 mm to about 30 mm. However, this is an example, and the thread portion 142 is not limited to a particular length. Also, the thread portion 142 may be formed in a cylindrical shape entirely extending in a longitudinal direction. However, this is an example, and the thread portion 142 is not limited to a particular shape.

At least one of the thread portion 142 and the filter portion 141 may include a flavoring.

To this end, for example, a flavoring liquid may be injected into the thread portion 142 or an additional fiber coated with a flavoring liquid may be inserted into the thread portion 412. Also, the thread portion 142 may include at least one capsule. As an example, the capsule may include a flavoring liquid, and flavors may be generated by the flavoring liquid that leaks due to crushing of the capsule. As another example, a capsule may include an aerosol generating material, and flavors may be generated by the aerosol generating material that leaks due to crushing of the capsule. The capsule may have a configuration in which a flavoring liquid or an aerosol generating material is wrapped with a film. The capsule may have a spherical or cylindrical shape but is not limited thereto.

When the thread portion 142 and the filter portion 141 include flavorings, respectively, a first flavoring included in the thread portion 142 and a second flavoring included in the filter portion 141 may be different from each other. Alternatively, the first flavoring and the second flavoring may be the same.

The thread portion 142 may be made of a material different from that of the filter portion 141. For example, the thread portion 142 may be made of a material having a greater density than the filter portion 141. In this case, a larger amount of aerosol may flow through the filter portion 141 than through the thread portion 142. Accordingly, in the aerosol generating article 1 according to one or more embodiments, a flavoring included in the thread portion 142 may stay inside the thread portion 142 for a relatively long time, and thus, a flavor persistence may be improved. For example, the thread portion 142 may have a density within a range of about 450 $kg/m^3$ to about 750 $kg/m^3$, and the filter portion 141 may have a density within a range of about 60 $kg/m^3$ to about 140 $kg/m^3$.

The thread portion 142 may be made of a material capable of cooling an aerosol. Therefore, the aerosol generating article 1 may provide an improved cooling effect by cooling the aerosol through the cooling unit 13 and cooling the aerosol again through the thread portion 142. For example, the thread portion 142 may include polylactic acid.

The thread portion 142 may be formed to have a less volume than the filter portion 141. As such, the aerosol generating article 1 according to one or more embodiments may increase, in the thread filter 14, an area through which an aerosol may easily flow, thereby increasing an amount of atomization. The thread portion 142 may have a less diameter than the filter portion 141.

As shown in FIG. 2, the thread portion 142 may be arranged in the center of an area occupied by the filter portion 141. Accordingly, the aerosol generating article 1 according to one or more embodiments may be implemented so that a flavoring included in the thread portion 142 may be uniformly spread in a radial direction.

FIG. 3 is a schematic side cross-sectional view of a thread filter 14 according to another embodiment.

Referring to FIG. 3, a thread portion 142 may be shorter than a filter portion 141 along a lengthwise direction of the aerosol generating article. In this case, the thread portion 142 may be spaced apart from a downstream end 14*a* of the thread filter 14. As such, the thread portion 142 is not exposed out of the end 14*a* of the thread filter 14, thereby preventing a damage to the thread portion 142 due to an external foreign matter. FIG. 3 illustrates that the thread portion 142 is spaced apart from the downstream end 14*a* of the thread filter 14 and extends to the upstream end 14*b* of the thread filter 14. However, this is an example, and the thread portion 142 may be spaced apart from each of the end 14*a* and the other end 14*b* of the thread filter 14.

FIGS. 4A through 4D are schematic side cross-sectional views illustrating examples of an aerosol generating article.

Referring to FIG. 4A, an outer surface of an aerosol generating article 1 may be surrounded by a wrapping material 15. Also, a thermally conductive wrapper 16 for conducting heat may be arranged on a partial area or the entire area between the wrapping material 15, and an aerosol generating unit 11 and a tobacco filling unit 12. The thermally conductive wrapper 16 may be arranged on outer surfaces of the aerosol generating unit 11 and the tobacco filling unit 12.

Referring to FIG. 4B, the tobacco filling unit 12 may have a cooling hole 121. In this case, first cooling of an aerosol is performed by the cooling hole 121 of the tobacco filling unit 12, and secondary cooling may be performed by the cooling unit 13 through which the first cooled aerosol passes. Accordingly, the aerosol generating article 1 according to one or more embodiments may improve an overall cooling performance. The cooling hole 121 may not be provided according to a material of the cooling unit 13.

Referring to FIG. 4C, the aerosol generating unit 11 may be arranged at a downstream end of the tobacco filling unit 12. In other words, the aerosol generating article 1 of FIG. 4A is different from the aerosol generating article 1 of FIG. 4C in an order in which the aerosol generating unit 11 and the tobacco filling unit 12 are arranged.

Referring to FIG. 4D, a thermally conductive wrapper 16 may be arranged on a portion of outer surfaces of the tobacco filling unit 12 and the aerosol generating unit 11. In other words, the thermally conductive wrapper 16 may be formed to have a less length than the aerosol generating unit 11 and the tobacco filling unit 12 combined.

FIGS. 5A through 5G are schematic side cross-sectional views illustrating other examples of an aerosol generating article.

When compared with FIGS. 4A through 4D, FIGS. 5A through 5E illustrate examples of aerosol generating units 21, 211, 212, and 213 including nicotine. Also, FIGS. 5F and 5G illustrate examples in which an aerosol generating unit 24 and a nicotine including portion 25 are separate segments.

The aerosol generating units 21, 211, 212, and 213 of FIGS. 5A through 5E may correspond to a combination of the aerosol generating unit 11 and the tobacco filling unit 12 of FIGS. 4A through 4D. The aerosol generating unit 24 of FIGS. 5F and 5G may correspond to the aerosol generating unit 11 of FIGS. 4A through 4D.

An outer surface of an aerosol generating article 2 of FIGS. 5A through 5G may be surrounded by a wrapping material 15. Also, according to one or more embodiments, the aerosol generating article 2 may further include a thermally conductive wrapper 16. Alternatively, as shown in FIG. 5B, the aerosol generating article 2 may not include a thermally conductive wrapper 16.

While the aerosol generating unit 21 is a single segment in FIG. 5A, the aerosol generating unit 21 may include multiple segments 211 and 212 according to an embodiment, as shown in FIG. 5C.

Referring to FIGS. 5D and 5E, the aerosol generating article 2 may include a length extension portion 214 which may be made of cellulous acetate. For example, the length extension portion 214 may be manufactured by adding a plasticizer (e.g., triacetin) to a cellulose acetate tow.

A cooling unit 22, and a filter portion 231 and a thread portion 232 of a thread filter 23 shown in FIGS. 5A through 5G may be implemented to be substantially the same as those described with reference to FIGS. 1 through 4D, and thus the detailed description thereof will be omitted herein.

As shown in FIGS. 5F and 5G, the aerosol generating article 2 may include a nicotine including portion 25. The nicotine including portion 25 may include nicotine obtained by shaping or reconstituting tobacco leaves. In one or more embodiments, the nicotine including portion 25 may include free base nicotine, nicotine salt, or a combination thereof. For example, the nicotine including portion 25 may be implemented by a crimped sheet in which nicotine is impregnated. Also, a flavoring liquid or other additives, such as flavors, a wetting agent, or an organic acid, may be included in the crimped sheet.

The crimped sheet may be a sheet made of a polymer material. For example, the polymer material may include at least one of paper, cellulose acetate, lyocell, and polylactic acid. For example, the crimped sheet may be a paper sheet that does not generate off-flavor due to heat even when heated to a high temperature. However, the crimped sheet is not limited thereto.

FIGS. 6A through 6D are schematic side cross-sectional views illustrating examples of a cooling unit of an aerosol generating article.

FIGS. 6A through 6D illustrate examples of cooling units 31, 32, 33, and 34, respectively.

Referring to FIGS. 6A through 6C, the cooling units 31, 32, and 33 include segments 312, 322, and 332 made of a polylactic acid and other segments 311, 321, and 331. Here, the other segments 311, 321, and 331 may be made of cellulose acetate and/or paper. Also, the other segments 311, 321, and 331 may have hollows but are not limited thereto.

Referring to FIG. 6D, the cooling unit 34 may be made of paper and may be a tube-shaped structure having a hollow inside. For example, an inner or outer surface of the cooling unit 34 may be coated with a certain material (e.g., a polylactic acid).

Also, although not shown in FIGS. 1 through 6D, the aerosol generating article 1 or 2 may further include a plug at a front end (i.e., upstream end) of the aerosol generating article. For example, the plug may be made of cellulose acetate but is not limited thereto.

FIGS. 7 and 8 are diagrams showing examples in which an aerosol generating article is inserted into an aerosol generating device.

Referring to FIGS. 7 and 8, an aerosol generating device 100 may include a battery 101, a controller 102, a heater 103, and a vaporizer 104. Also, the aerosol generating article 1 may be inserted into an inner space of the aerosol generating device 100.

FIGS. 7 and 8 illustrate components of the aerosol generating device 100, which are related to the present embodiment. Therefore, it will be understood by one of ordinary skill in the art related to the present embodiment that other general-purpose components may be further included in the aerosol generating device 100, in addition to the components illustrated in FIGS. 7 and 8.

Also, FIGS. 7 and 8 illustrate that the aerosol generating device 100 includes the heater 103. However, as necessary, the heater 103 may be omitted.

FIG. 7 illustrates that the battery 101, the controller 102, the vaporizer 104, and the heater 103 are arranged in series. Also, FIG. 8 illustrates that the vaporizer 104 and the heater 103 are arranged in parallel. However, the internal structure of the aerosol generating device 100 is not limited to the structures illustrated in FIG. 7 or FIG. 8. In other words, according to the design of the aerosol generating device 100, the battery 101, the controller 102, the heater 103, and the vaporizer 104 may be differently arranged.

When the aerosol generating article 1 is inserted into the aerosol generating device 100, the aerosol generating device 100 may operate the vaporizer 104 to generate aerosol from the aerosol generating article 1 and/or the vaporizer 104. The aerosol generated by the heater 103 and/or the vaporizer 104 is delivered to the user by passing through the aerosol generating article 1.

According to one or more embodiments, even when the aerosol generating article 1 is not inserted into the aerosol generating device 100, the heater 103 of the aerosol generating device 100 may perform heating.

The battery 101 may supply power to be used for the aerosol generating device 100 to operate. For example, the battery 101 may supply power to heat the heater 103 or the vaporizer 104, and may supply power for operating the controller 102. Also, the battery 101 may supply power for operations of a display, a sensor, a motor, etc. mounted in the aerosol generating device 100.

The controller 102 may generally control operations of the aerosol generating device 100. In detail, the controller 102 may control not only operations of the battery 101, the heater 103, and the vaporizer 104, but also operations of other components included in the aerosol generating device 100. Also, the controller 102 may check a state of each of the components of the aerosol generating device 100 to determine whether or not the aerosol generating device 100 is able to operate.

The controller 102 may include at least one processor. A processor can be implemented as an array of a plurality of logic gates or can be implemented as a combination of a general-purpose microprocessor and a memory in which a program executable by the microprocessor is stored. It will be understood by one of ordinary skill in the art that the processor can be implemented in other forms of hardware.

The heater 103 may be heated by the power supplied from the battery 101. For example, when the aerosol generating article 1 is inserted into the aerosol generating device 100, the heater 103 may be located outside the cigarette. Thus, the heated heater 103 may increase a temperature of an aerosol generating material in the aerosol generating article 1.

The heater 103 may include an electro-resistive heater. For example, the heater 103 may include an electrically conductive track, and the heater 103 may be heated when currents flow through the electrically conductive track. However, the heater 103 is not limited to the example described above and may include any other heaters which may be heated to a desired temperature. Here, the desired temperature may be pre-set in the aerosol generating device 100 or may be set by a user.

As another example, the heater 103 may include an induction heater. In detail, the heater 103 may include an electrically conductive coil for heating an aerosol generating article in an induction heating method, and the aerosol generating article may include a susceptor which may be heated by the induction heater.

For example, the heater 103 may include a tube-type heating element, a plate-type heating element, a needle-type heating element, or a rod-type heating element, and may heat the inside or the outside of the aerosol generating article 1, according to the shape of the heating element.

Also, the aerosol generating device 100 may include a plurality of heaters 103. Here, the plurality of heaters 103 may be inserted into the aerosol generating article 1 or may be arranged outside the aerosol generating article 1. Also, some of the plurality of heaters 103 may be inserted into the aerosol generating article 1, and the others may be arranged outside the aerosol generating article 1. In addition, the shape of the heater 103 is not limited to the shapes illustrated in FIGS. 7 and 8 and may include various shapes.

The vaporizer 104 may generate aerosol by heating a liquid composition and the generated aerosol may pass through the aerosol generating article 1 to be delivered to a user. In other words, the aerosol generated via the vaporizer 104 may move along an air flow passage of the aerosol generating device 100 and the air flow passage may be configured such that the aerosol generated via the vaporizer 104 passes through the cigarette to be delivered to the user.

For example, the vaporizer 104 may include a liquid storage, a liquid delivery element, and a heating element, but it is not limited thereto. For example, the liquid storage, the liquid delivery element, and the heating element may be included in the aerosol generating device 100 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 104 or may be formed integrally with the vaporizer 104.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be wound around the liquid delivery element. The heating element may be heated by a current supply and may transfer heat to the liquid composition in contact with the heating element, thereby heating the liquid composition. As a result, aerosol may be generated.

For example, the vaporizer 104 may be referred to as a cartomizer or an atomizer, but it is not limited thereto.

The aerosol generating device 100 may further include general-purpose components in addition to the battery 101, the controller 102, the heater 103 and the vaporizer 104. For example, the aerosol generating device 100 may include a display capable of outputting visual information and/or a motor for outputting haptic information. Also, the aerosol generating device 100 may include at least one sensor (e.g., a puff detecting sensor, a temperature detecting sensor, an aerosol generating article insertion detecting sensor, etc.). Also, the aerosol generating device 100 may be formed as a structure that, even when the aerosol generating article 1 is inserted into the aerosol generating device 10000, may introduce external air or discharge internal air.

Although not illustrated in FIGS. 7 and 8, the aerosol generating device 100 and an additional cradle may form together a system. For example, the cradle may be used to charge the battery 101 of the aerosol generating device 100. Alternatively, the heater 103 may be heated when the cradle and the aerosol generating device 100 are coupled to each other.

The first portion may be completely inserted into the aerosol generating device 100, and the second portion may be exposed to the outside. Alternatively, only a portion of the first portion may be inserted into the aerosol generating device 100, or a portion of the first portion and a portion of the second portion may be inserted thereinto. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 100. For example, opening and closing of the air passage and/or a size of the air passage formed in the aerosol generating device 100 may be adjusted by the user. Accordingly, the amount of smoke and a smoking impression may be adjusted by the user. As another example, the external air may flow into the aerosol generating article 1 through at least one hole formed in a surface of the aerosol generating article 1.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating article comprising:

an aerosol generating unit including an aerosol generating material;

a tobacco filling unit arranged at a downstream end of the aerosol generating unit;

a cooling unit arranged at a downstream end of the tobacco filling unit and configured to cool an aerosol; and a thread filter arranged at a downstream end of the cooling unit and including a filter portion and a thread portion which have different flow rates of the aerosol, wherein the thread portion is shorter than the filter portion in a lengthwise direction of the aerosol generating article such that the thread portion is enclosed by the filter portion at the downstream end, and wherein the thread portion is not exposed at a downstream end of the thread filter.

2. The aerosol generating article of claim 1, wherein the thread portion is made of a material different from that of the filter portion.

3. The aerosol generating article of claim 1, wherein the thread portion has a greater density than the filter portion such that a larger amount of aerosol flows through the filter portion than through the thread portion.

4. The aerosol generating article of claim 3, wherein the thread portion has a density in a range of about 450 $kg/m^3$ to about 750 $kg/m^3$, and the filter portion has a density in a range of about 60 $kg/m^3$ to about 140 $kg/m^3$.

5. The aerosol generating article of claim 1, wherein the thread portion is made of a polylactic acid, and the filter portion is made of cellulose acetate.

6. The aerosol generating article of claim 1, wherein the filter portion has a greater volume than the thread portion.

7. The aerosol generating article of claim 1, wherein the thread portion is arranged in a center of an area occupied by the filter portion.

8. The aerosol generating article of claim 1, wherein at least one of the thread portion and the filter portion includes a flavoring.

9. The aerosol generating article of claim 1, wherein the cooling unit has at least one perforation configured to introduce external air.

10. The aerosol generating article of claim 9, wherein a distance between the at least one perforation and the downstream end of the cooling unit is greater than a distance between the at least one perforation and an upstream end of the cooling unit.

11. The aerosol generating article of claim 1, further comprising:

a thermally conductive wrapper configured to conduct heat, wherein the thermally conductive wrapper is arranged on outer surfaces of the aerosol generating unit and the tobacco filling unit.

* * * * *